US011188113B2

(12) United States Patent
Wu et al.

(10) Patent No.: US 11,188,113 B2
(45) Date of Patent: Nov. 30, 2021

(54) BAND GAP REFERENCE VOLTAGE GENERATING CIRCUIT

(71) Applicant: NUVOTON TECHNOLOGY CORPORATION, Hsinchu (TW)

(72) Inventors: Chang-Xian Wu, Hsinchu Science Park (TW); Chun-Ku Lin, Hsinchu Science Park (TW)

(73) Assignee: NUVOTON TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 16/820,015

(22) Filed: Mar. 16, 2020

(65) Prior Publication Data

US 2021/0072781 A1 Mar. 11, 2021

(30) Foreign Application Priority Data

Sep. 10, 2019 (TW) ..... 108132659

(51) Int. Cl.
*G05F 3/30* (2006.01)
*G05F 3/22* (2006.01)

(52) U.S. Cl.
CPC . *G05F 3/30* (2013.01); *G05F 3/22* (2013.01)

(58) Field of Classification Search
CPC ..... G05F 3/22; G05F 3/30
See application file for complete search history.

(56) References Cited

U.S. PATENT DOCUMENTS

2008/0278137 A1* 11/2008 Harvey ..... G05F 3/30 323/311

* cited by examiner

*Primary Examiner* — Jue Zhang
(74) *Attorney, Agent, or Firm* — Muncy, Geissler, Olds & Lowe, P.C.

(57) ABSTRACT

A band gap reference voltage generating circuit includes a reference voltage generating circuit, a current generating circuit, a current divider circuit, and a first connection path switching circuit. The reference voltage generating circuit forms a reference voltage on first and second current input terminals thereof. First and second input terminals of the current generating circuit are connected to the first and second current input terminals, respectively. The current generating circuit generates a first current to bias the reference voltage generating circuit. The current divider circuit includes a current input terminal, a first current output terminal, and a second current output terminal. The first connection path switching circuit switches connection paths between the first input terminal and the second input terminal of the current generating circuit, and the first current input terminal and the second current input terminal of the current divider circuit.

9 Claims, 16 Drawing Sheets

BAND GAP REFERENCE VOLTAGE GENERATING CIRCUIT

This application claims the priority benefit of Taiwan application no. 108132659, filed on Sep. 10, 2019. The entirety of the above-mentioned patent application is hereby incorporated by reference herein and made a part of this specification.

BACKGROUND OF THE INVENTION

1. Field of the Invention

The present invention relates to a band gap reference voltage generating circuit, and more particularly to a band gap reference voltage generating circuit which is able to prevent a reference voltage from being affected by temperature because of resistance deviation.

2. Description of the Related Art

Please refer to FIG. 1, which is a simple circuit diagram of a conventional band gap reference voltage generating circuit. As shown in FIG. 1, the conventional band gap reference voltage generating circuit includes at least two bipolar junction transistors Q1 and Q2, a PMOS transistor $M_1$, resistors $R_{1A}$, $R_{1B}$, $R_2$ and $R_3$, and an operational amplifier OP. The resistor $R_3$ is electrically connected between the PMOS transistor $M_1$ and the resistor $R_{1A}$, terminals of the resistors $R_{1A}$ and $R_{1B}$ are electrically connected to the resistor R3, and the other terminals of the resistors $R_{1A}$ and $R_{1B}$ are electrically connected to a negative input terminal and a positive input terminal of the operational amplifier OP, respectively. The resistor $R_2$ is electrically connected between the resistor $R_{1B}$ and an emitter of the bipolar junction transistor $Q_2$.

The bipolar junction transistors Q1 and Q2 are PNP bipolar junction transistors, and an emitter area of the bipolar junction transistor $Q_2$ is multiple times of that of the PNP bipolar junction transistor $Q_1$, so a base-emitter voltage $V_{BE2}$ of the PNP bipolar junction transistor $Q_2$ is different from a base-emitter voltage $V_{BE1}$ of the PNP bipolar junction transistor $Q_1$.

The feedback mechanism can keep voltages on two input terminals of the operational amplifier OP equivalent to each other. When resistance value of the resistor $R_{1A}$ is equal to that of the resistor R1B, the currents flowing through the PNP bipolar junction transistors Q1 and Q2 are the same. Since the emitter area of the PNP bipolar junction transistor Q2 is multiple times of that of the PNP bipolar junction transistor Q1, the base-emitter voltage VBE2 of the PNP bipolar junction transistor Q2 is different from the base-emitter voltage VBE1 of the PNP bipolar junction transistor Q1, and ΔVBE is the base-emitter voltage VBE1 of the PNP bipolar junction transistor Q1 minus the base-emitter voltage $V_{BE2}$ of the PNP bipolar junction transistor Q2, and a reference voltage $V_{OUT}$ can be calculated according to an equation (1) shown below.

The forwardly-conducted base-emitter voltage $V_{BE1}$ has a negative temperature coefficient, that is, a value of $$\frac{\partial V_{BE1}}{\partial T}$$

is negative; and $\Delta V_{BE}$ is a positive temperature coefficient, that is, a value of $$\frac{\partial \Delta V_{BE}}{\partial T}$$

is positive. Therefore, in order to obtain the reference voltage VOUT independent of temperature, that is, the value of $$\frac{\partial V_{out}}{\partial T} = 0$$

is zero, the parameter $$\frac{(R_1 + 2R_3)}{R_2}$$

can be regulated according to equations (2) and (3) shown below.

$$V_{out} = V_{BE1} + \frac{\Delta V_{BE}}{R_2}(R_1 + 2R_3) \tag{1}$$

$$\frac{\partial V_{out}}{\partial T} = \frac{\partial V_{BE1}}{\partial T} + \frac{\partial \Delta V_{BE}}{\partial T}\frac{(R_1 + 2R_3)}{R_2} = 0 \tag{2}$$

$$\frac{\partial V_{BE1}}{\partial T} = -\frac{\partial \Delta V_{BE}}{\partial T} \times \frac{(R_1 + 2R_3)}{R_2} \tag{3}$$

However, in fact application, a deviation between the resistance values of the resistors $R_{1A}$ and $R_{1B}$ inevitably exists even under accurate control, and the deviation causes that the conventional band gap reference voltage generating circuit fails to effectively output the reference voltage $V_{OUT}$ independent of temperature. The effect of the resistance deviation on the correlation between the reference voltage $V_{OUT}$ and temperature is illustrated in the following paragraphs.

It is assumed that the resistance deviation is denoted by ε, according to an equation (4), and the currents flowing through the resistor $R_{1A}$ and $R_{1B}$ are $I_1$ and $I_2$, respectively, and the current flowing through the resistor $R_3$ to is $I_3$. The relationship between the reference voltage $V_{OUT}$ and the resistance deviation E can be derived according to equations (6) and (7), and the correlation between the reference voltage $V_{OUT}$ and temperature can be expressed by an equation (8).

$$R_{1A} = R_1(1+\varepsilon),\ R_{1B} = R_1 \tag{4}$$

$$I_1 = \frac{V_X - V_Y}{R_1(1+\varepsilon)},\ I_2 = \frac{V_X - V_Y}{R_1} = \frac{\Delta V_{BE}}{R_2} = I_1(1+\varepsilon) \tag{5}$$

$$I_3 = I_1 + I_2 = \Delta V_{BE} \times \left(\frac{1}{R_2(1+\varepsilon)} + \frac{1}{R_2}\right) = \Delta V_{BE} \times \frac{(2+\varepsilon)}{R_2(1+\varepsilon)} \tag{6}$$

$$V_{out,\varepsilon} = V_{BE1} + I_3R_3 + I_1R_1(1+\varepsilon) = V_{BE1} + \Delta V_{BE}\frac{(2+\varepsilon)}{R_2(1+\varepsilon)}R_3 + \Delta V_{BE}\frac{R_1}{R_2} = V_{BE1} + \Delta V_{BE}\left(\frac{R_1(1+\varepsilon) + R_3(2+\varepsilon)}{R_2(1+\varepsilon)}\right) \tag{7}$$

-continued $$\frac{\partial V_{out,\varepsilon}}{\partial T} = \frac{\partial V_{BE1}}{\partial T} + \frac{\partial \Delta V_{BE}}{\partial T} \times \left( \frac{R_1(1+\varepsilon) + R_3(2+\varepsilon)}{R_2(1+\varepsilon)} \right) \quad (8)$$

$$\frac{\partial V_{out,\varepsilon}}{\partial T} = \left( \frac{-\varepsilon R_3}{R_2(1+\varepsilon)} \right) \quad (9)$$

The equation (9) indicates that the temperature effect on the reference voltage $V_{OUT}$ is related to the resistance deviation ε, and even the resistor parameter is well regulated according to the equation (3), the reference voltage $V_{OUT}$ is still affected by temperature,

SUMMARY OF THE INVENTION

An objective of the present invention is to provide a band gap reference voltage generating circuit to prevent a reference voltage of the band gap reference voltage generating circuit from being affected by temperature because of resistance deviation.

In order to achieve the objective, the present invention provides a band gap reference voltage generating circuit, comprising a reference voltage generating circuit, a current generating circuit, a current divider circuit, a first connection path switching circuit and a control circuit. The reference voltage generating circuit includes a first current input terminal and a second current input terminal, and is configured to form a reference voltage on the first current input terminal and the second current input terminal. The current generating circuit includes a first input terminal and a second input terminal electrically connected to the first current input terminal and the second current input terminal, respectively, wherein the current generating circuit is configured to generate a first current to bias the reference voltage generating circuit. The current divider circuit includes a current input terminal, a first current output terminal and a second current output terminal, wherein the current input terminal receives the first current, and the voltage on the current input terminal of the current divider circuit serves as an output voltage of the band gap reference voltage generating circuit. The first connection path switching circuit is electrically connected between the current generating circuit and the current divider circuit, and configured to switch connection paths between the first input terminal and the second input terminal of the current generating circuit and the first current output terminal and the second current output terminal of the current divider circuit. The control circuit is configured to generate a first control signal to periodically control a switching operation of the first connection path switching circuit.

According to an embodiment, the current divider circuit comprises a first resistor, a second resistor, and a third resistor, the first resistor has a terminal electrically connected to the current generating circuit, and other terminal electrically connected to terminals of the second resistor and the third resistor, and other terminals of the second resistor and the third resistor are electrically connected to the first connection path switching circuit.

According to an embodiment, the reference voltage generating circuit comprises a first bipolar junction transistor, a second bipolar junction transistor, and a fourth resistor, an emitter of the first bipolar junction transistor is electrically connected to the first connection path switching circuit, and base and collector of the first bipolar junction transistor are electrically connected to each other, an emitter of the second bipolar junction transistor is electrically connected to a terminal of the fourth resistor, base and collector of the second bipolar junction transistor are electrically connected to the base of the first bipolar junction transistor, other terminal of the fourth resistor is electrically connected to the first connection path switching circuit, and an emitter area of the second bipolar junction transistor is multiple times of an emitter area of the first bipolar junction transistor.

According to an embodiment, the first connection path switching circuit comprises a first switch, a second switch, a third switch, and a fourth switch, terminals of the first switch and the second switch are electrically connected to the first current output terminal of the current divider circuit, and other terminals of the first switch and the second switch are electrically connected to the first current input terminal and the second current input terminal of the reference voltage generating circuit, respectively, and terminals of the third switch and the fourth switch are electrically connected to the second current output terminal of the current divider circuit, and other terminals of the third switch and the fourth switch are electrically connected to the first current input terminal and the second current input terminal of the reference voltage generating circuit, respectively.

According to an embodiment, the current generating circuit comprises a first operational amplifier, a signal filter, and a MOS transistor, a first input terminal of the first operational amplifier serves as the first input terminal of the current generating circuit, a second input terminal of the first operational amplifier serves as the second input terminal of the current generating circuit, an output terminal of the first operational amplifier is electrically connected to the input terminal of the signal filter, an output terminal of the signal filter is electrically connected to a gate of the MOS transistor, a source of the MOS transistor receives a supply voltage, and a drain of the MOS transistor outputs the first current.

According to an embodiment, the current generating circuit comprises a second operational amplifier, a signal filter, and a MOS transistor, a first input terminal of the second operational amplifier serves as the first input terminal of the current generating circuit, a second input terminal of the second operational amplifier serves as the second input terminal of the current generating circuit, an output terminal of the second operational amplifier is electrically connected to an input terminal of the signal filter, an output terminal of the signal filter is electrically connected to a gate of the MOS transistor, a source of the MOS transistor receives a supply voltage, and a drain of the MOS transistor output the first current. The band gap reference voltage generating circuit comprises a second connection path switching circuit electrically connected between the current generating circuit and the first connection path switching circuit, and configured to switch the connection paths between the two input terminals of the second operational amplifier of the current generating circuit, and the two output terminals of the first connection path switching circuit. The polarities of the two input terminals of the second operational amplifier are exchangeable.

According to an embodiment, the control circuit generates a second control signal to periodically control a switching operation of the second connection path switching circuit to exchange the polarities of the input terminals of the second operational amplifier.

In order to achieve the objective, the present invention provides a band gap reference voltage generating circuit comprising: a reference voltage generating circuit comprising a first current input terminal and a second current input terminal, and configured to form a reference voltage on the first current input terminal and the second current input terminal; a current generating circuit comprising a first input terminal and a second input terminal electrically connected to the first current input terminal and the second current input terminal, respectively, wherein the current generating circuit is configured to generate a first current to bias the reference voltage generating circuit, wherein the current generating circuit comprises an operational amplifier, a signal filter, and a MOS transistor, a first input terminal of the operational amplifier serves as the first input terminal of the current generating circuit, a second input terminal of the operational amplifier serves as the second input terminal of the current generating circuit, an output terminal of the operational amplifier is electrically connected to the input terminal of the signal filter, and polarities of two input terminals of the operational amplifier is exchangeable, an output terminal of the signal filter is electrically connected to a gate of the MOS transistor, a source of the MOS transistor receives a supply voltage, and a drain of the MOS transistor outputs the first current; a current divider circuit comprising a current input terminal, a first current output terminal, and a second current output terminal, wherein the current input terminal receives the first current, and the voltage on the current input terminal of the current divider circuit serves as the output voltage of the band gap reference voltage generating circuit; a connection path switching circuit electrically connected between the current generating circuit and the reference voltage generating circuit, and configured to switch connection paths between the first input terminal and the second input terminal of the current generating circuit, and the first current input terminal and the second current input terminal of the reference voltage generating circuit; and a control circuit configured to generate a first control signal to periodically control a switching operation of the connection path switching circuit, and generate a second control signal to periodically exchange the polarities of the two input terminals of the operational amplifier.

According to an embodiment, the current divider circuit comprises a first resistor, a second resistor, and a third resistor, a terminal of the first resistor is electrically connected to the current generating circuit, and other terminal of the first resistor is electrically connected to terminals of the second resistor and the third resistor, and other terminals of the second resistor and the third resistor are electrically connected to the connection path switching circuit.

According to an embodiment, the connection path switching circuit comprises a first switch, a second switch, a third switch, and a fourth switch, terminals of the first switch and the second switch are electrically connected to the first input terminal of the current generating circuit, and other terminals of the first switch and the second switch are electrically connected to the first current input terminal and the second current input terminal of the reference voltage generating circuit, respectively, wherein terminals of the third switch and the fourth switch are electrically connected to the second input terminal of the current generating circuit, and other terminals of the third switch and the fourth switch are electrically connected to the first current input terminal and the second current input terminal of the reference voltage generating circuit, respectively.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
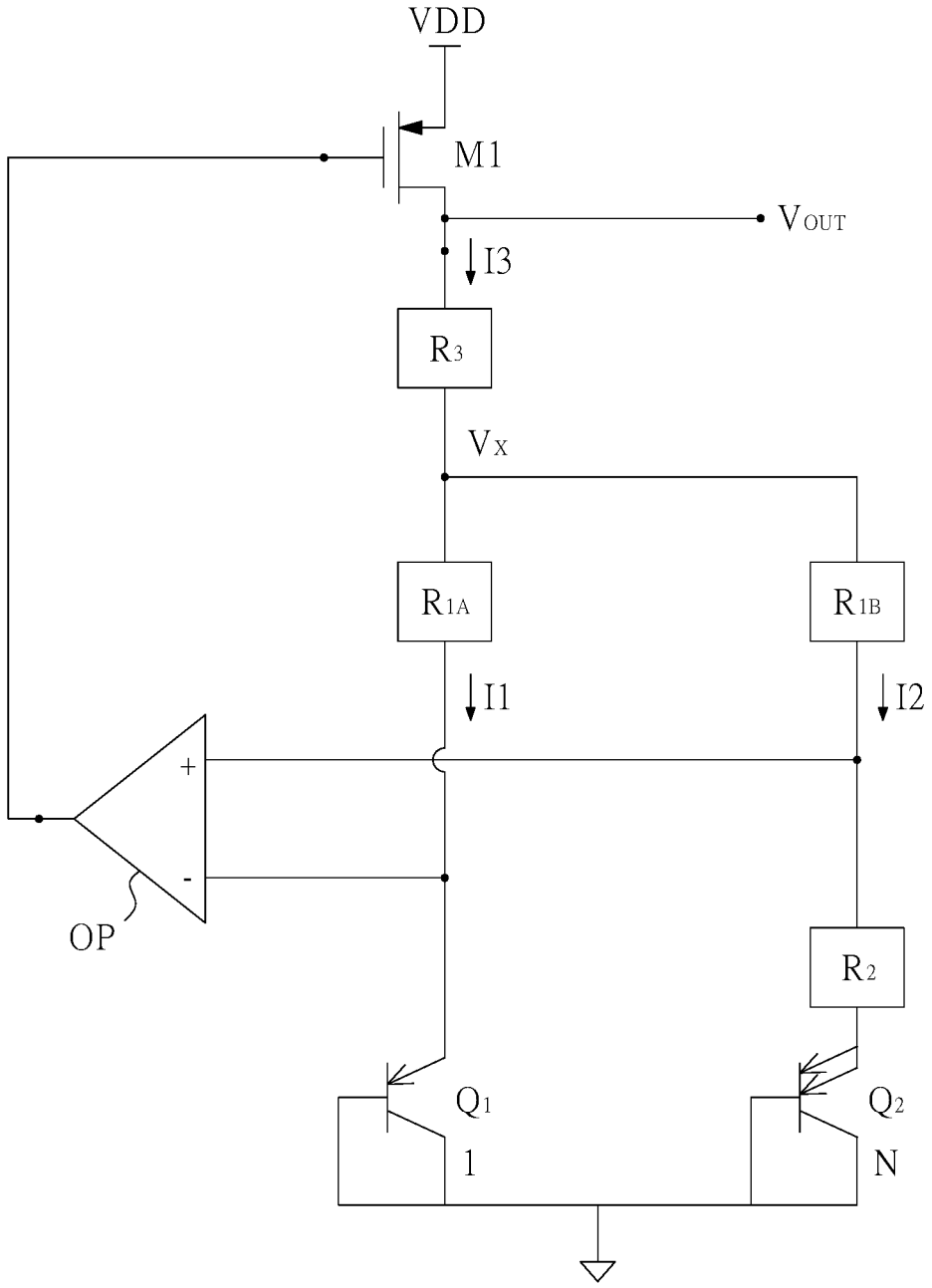
FIG. 1 is a schematic circuit diagram of a conventional band gap reference voltage generating circuit.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise" and variations such as "comprises" or "comprising", will be acknowledged to imply the inclusion of stated elements but not the exclusion of any other elements.

Figure 2:
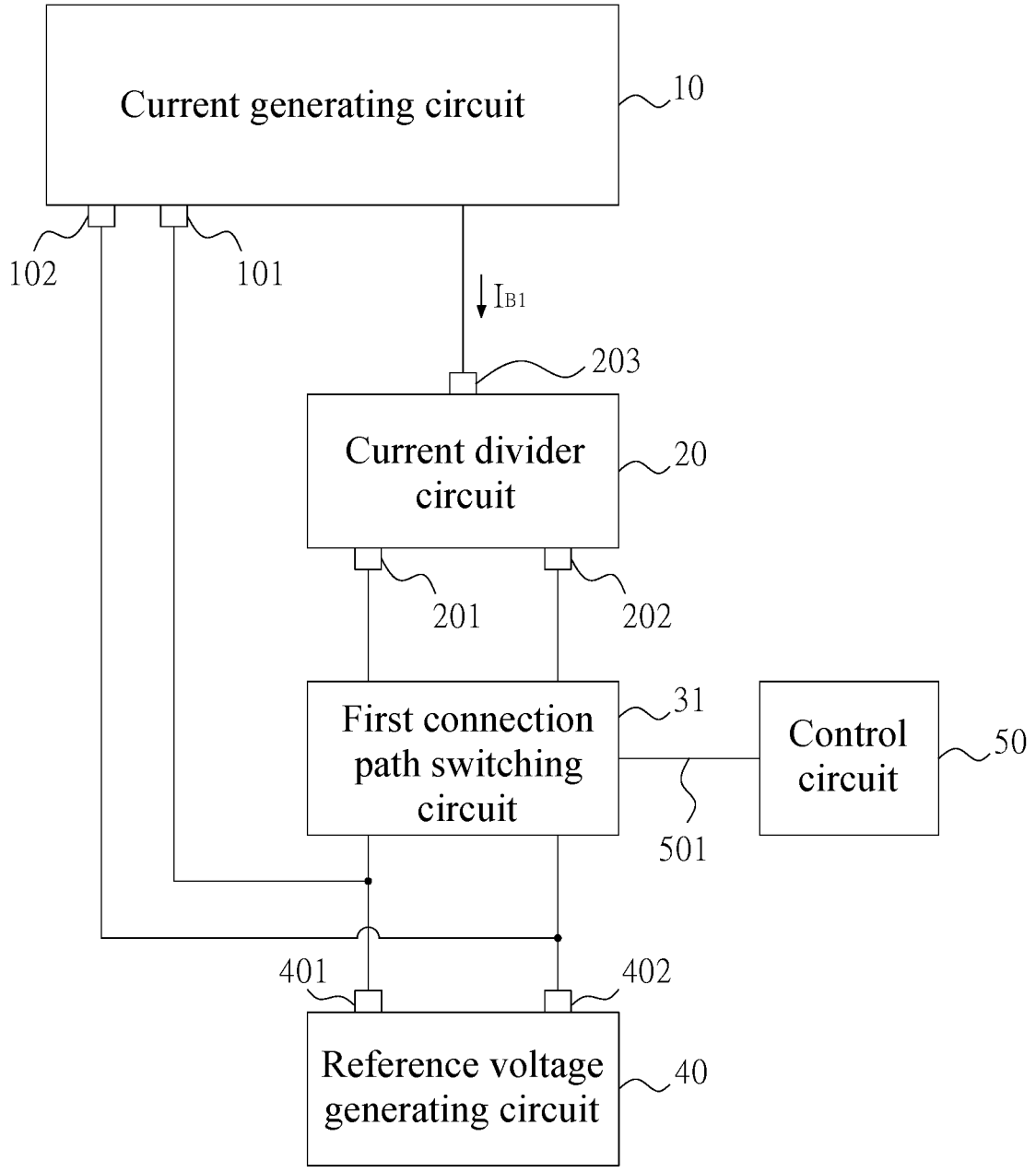
FIG. 2 is a block diagram of a band gap reference voltage generating circuit of the present invention.

Please refer to FIG. 2, which is a block diagram of a band gap reference voltage generating circuit of the present invention. As shown in FIG. 2, the band gap reference voltage generating circuit comprises a current generating circuit 10, a current divider circuit 20, a first connection path switching circuit 31, and a reference voltage generating circuit 40, and a control circuit 50.

The reference voltage generating circuit 40 comprises a first current input terminal 401 and a second current input terminal 402, and the reference voltage generating circuit 40 forms the reference voltage on the first current input terminal 401 and the second current input terminal 402. In an embodiment, the reference voltage generating circuit 40 can comprise a first bipolar junction transistor and a second bipolar junction transistor, and an emitter area of the second bipolar junction transistor is multiple times of an emitter area of the first bipolar junction transistor. The detailed structure and operation of the present invention will be illustrated in following paragraphs.

The current generating circuit 10 comprises a first input terminal 101 and a second input terminal 102, the first input terminal 101 and the second input terminal 102 are electrically connected to the first current input terminal 401 and the second current input terminal 402, respectively, and configured to receive the reference voltage. The current generating circuit 10 generates and outputs a first current $I_{B1}$ flowing through the current divider circuit 20 and the first connection path switching circuit 31, and further flowing into the reference voltage generating circuit 40, so as to bias the reference voltage generating circuit 40.

The current divider circuit 20 comprises a current input terminal 203, a first current output terminal 201, and a second current output terminal 202. The current input terminal 203 receives the first current $I_{B1}$, and the voltage on the current input terminal 203 serves as the output voltage of the band gap reference voltage generating circuit of the present invention. The current flowing out from the first current output terminal 201 and the second current output terminal 202 matches a preset ratio; for example, the current flowing from the first current output terminal 201 can be equal to the current flowing out from the second current output terminal 202.

In an embodiment, the current divider circuit 20 includes a first resistor, a second resistor, and a third resistor. A terminal of the first resistor is electrically connected to the current generating circuit 10, and other terminal of the first resistor is electrically connected to terminals of the second resistor and the third resistor, and other terminals of the second resistor and the third resistor are electrically connected to the first connection path switching circuit 31. In a preferred embodiment, the second resistor and the third resistor have the substantially identical resistance values, so that the current flowing through the second resistor and the current flowing through the third resistor substantially is the same.

The first connection path switching circuit 31 is electrically connected between the current generating circuit 10 and the current divider circuit 20, and configured to switch the connection paths between the first input terminal 101 and the second input terminal 102 of the current generating circuit 10, and the first current output terminal 201 and the second current output terminal 202 of the current divider circuit 20.

In an embodiment, the first connection path switching circuit 31 includes a first switch, a second switch, a third switch, and a fourth switch. Terminals of the first switch and the second switch are electrically connected to the first current output terminal 201 of the current divider circuit 20, and other terminals of the first switch and the second switch are electrically connected to the first current input terminal 401 and the second current input terminal 402 of the reference voltage generating circuit 40, respectively; the terminals of the third switch and the fourth switch are electrically connected to the second current output terminal 202 of the current divider circuit 20, and other terminals of the third switch and the fourth switch are electrically connected to the first current input terminal 401 and the second current input terminal 402 of the reference voltage generating circuit 40, respectively.

The control circuit 50 generates a first control signal 501 to periodically control a switching operation of the first connection path switching circuit 31, for example, the first control signal 501 can periodically control the first switch, the second switch, the third switch, and the fourth switch. When the first switch and the fourth switch are turned on, the second switch and the third switch are turned off; when the second switch and the third switch are turned on, the first switch and the fourth switch are turned off.

In an ideal case, the currents flowing from the first current output terminal 201 and the second current output terminal 202 must match the preset ratio, for example, the current flowing out from the first current output terminal 201 is equal to the current flow out from the second current output terminal 202, so as to eliminate the correlation between the reference voltage VOUT and temperature. The current divider circuit 20 can be provided with two resistors to control the current flow out from the first current output terminal 201 and the second current output terminal 202, respectively, and resistance values of the two resistors can be set to make a ratio of the currents flowing from the first current output terminal 201 to the second current output terminal 202 as a preset ratio. However, in an actual application, a slight difference c inevitably exists between the resistance values of the two resistors even under accurate control for the resistance values of the resistors. According to the above-mentioned contents, the slight difference c between the resistance values of the two resistors affect the correlation between the reference voltage VOUT and temperature.

The first connection path switching circuit 31 periodically switch the connection paths between the first input terminal 101 and the second input terminal 102 of the current generating circuit 10, and the first current output terminal 201 and the second current output terminal 202 of the current divider circuit 20, so the first input terminal 101 of the current generating circuit 10 is periodically electrically connected to different resistors of the current divider circuit 20, and the second input terminal 102 of the current generating circuit 10 is also electrically connected to the different resistor of the current divider circuit 20 periodically, thereby effectively decreasing the effect of the resistance difference between the resistors of the current divider circuit 20 applied on the correlation between the reference voltage VOUT and the temperature.

Figure 3:
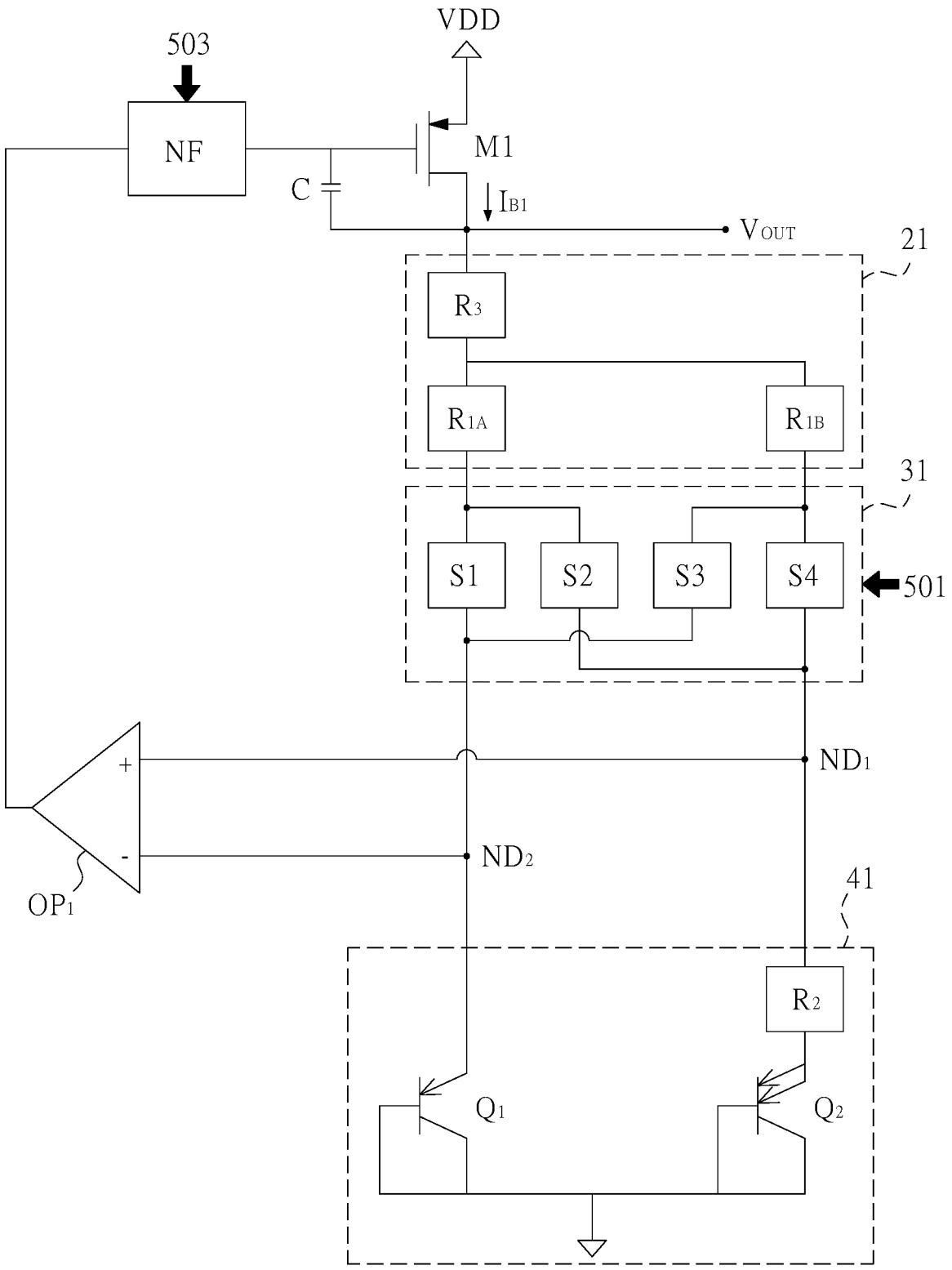
FIG. 3 is a schematic circuit diagram of a first embodiment of a band gap reference voltage generating circuit of the present invention.
Figure 4A:
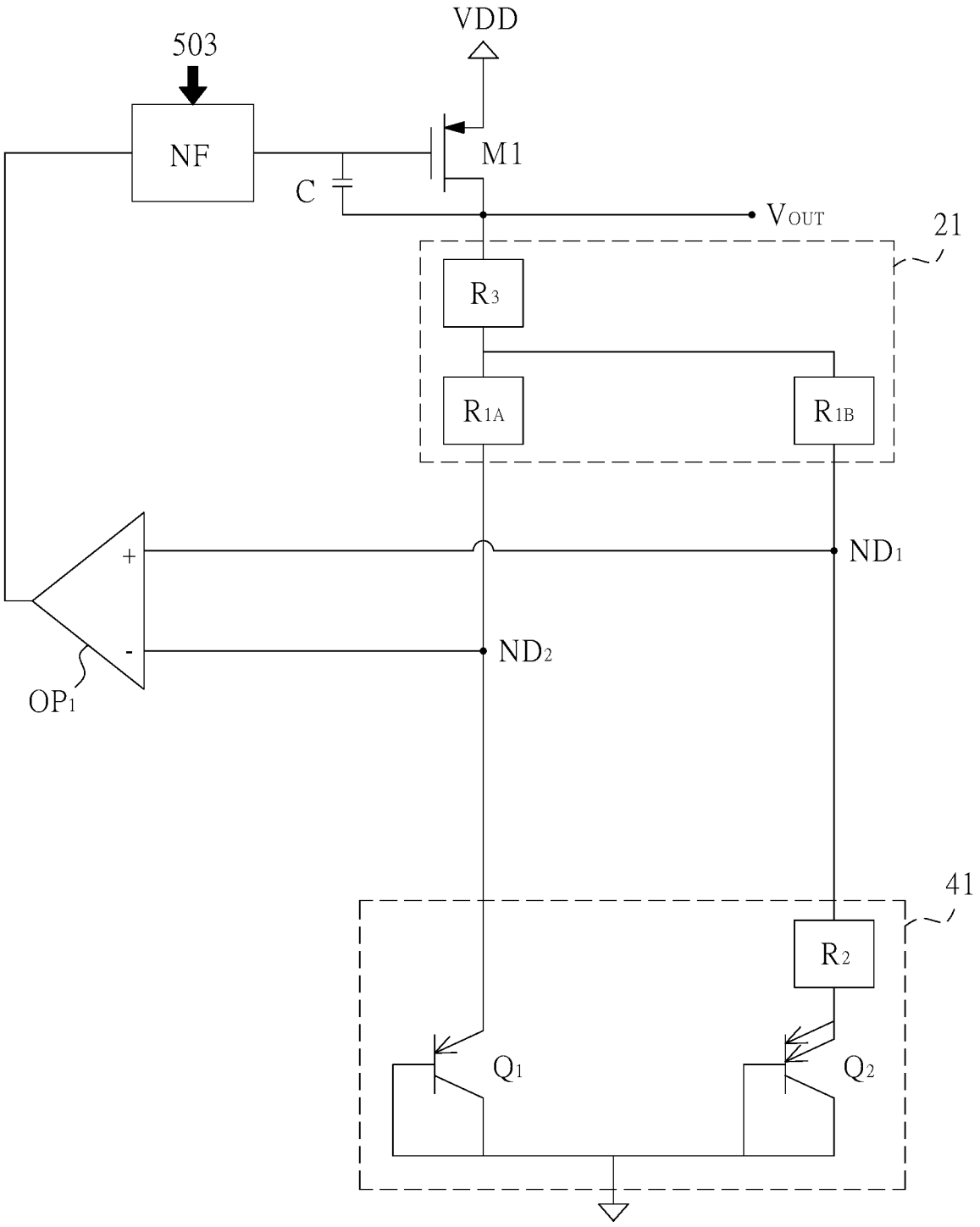
FIGS. 4A and 4B are schematic circuit diagrams showing different operational states of a first embodiment of a band gap reference voltage generating circuit of the present invention.
Figure 4B:
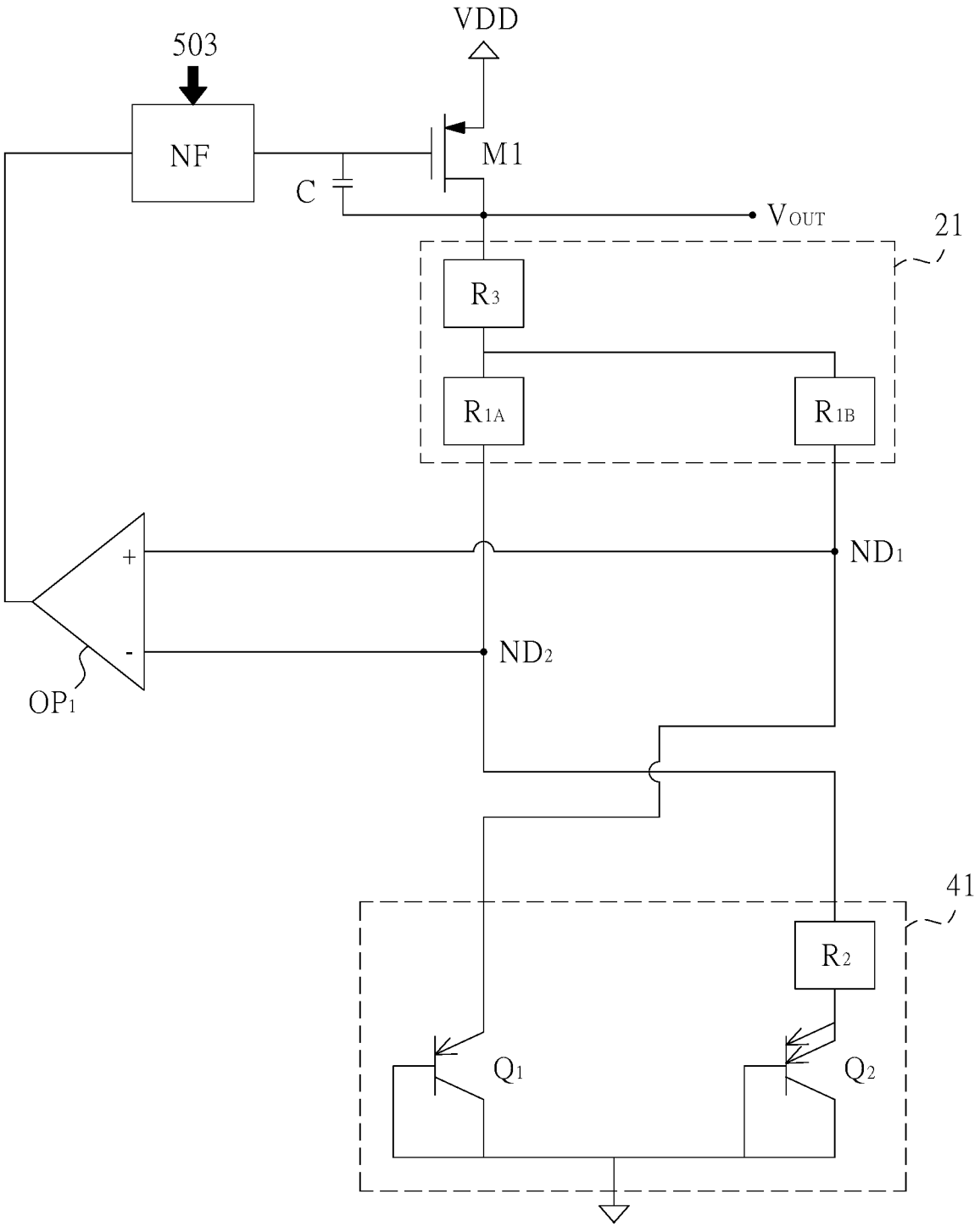
Figure 5:
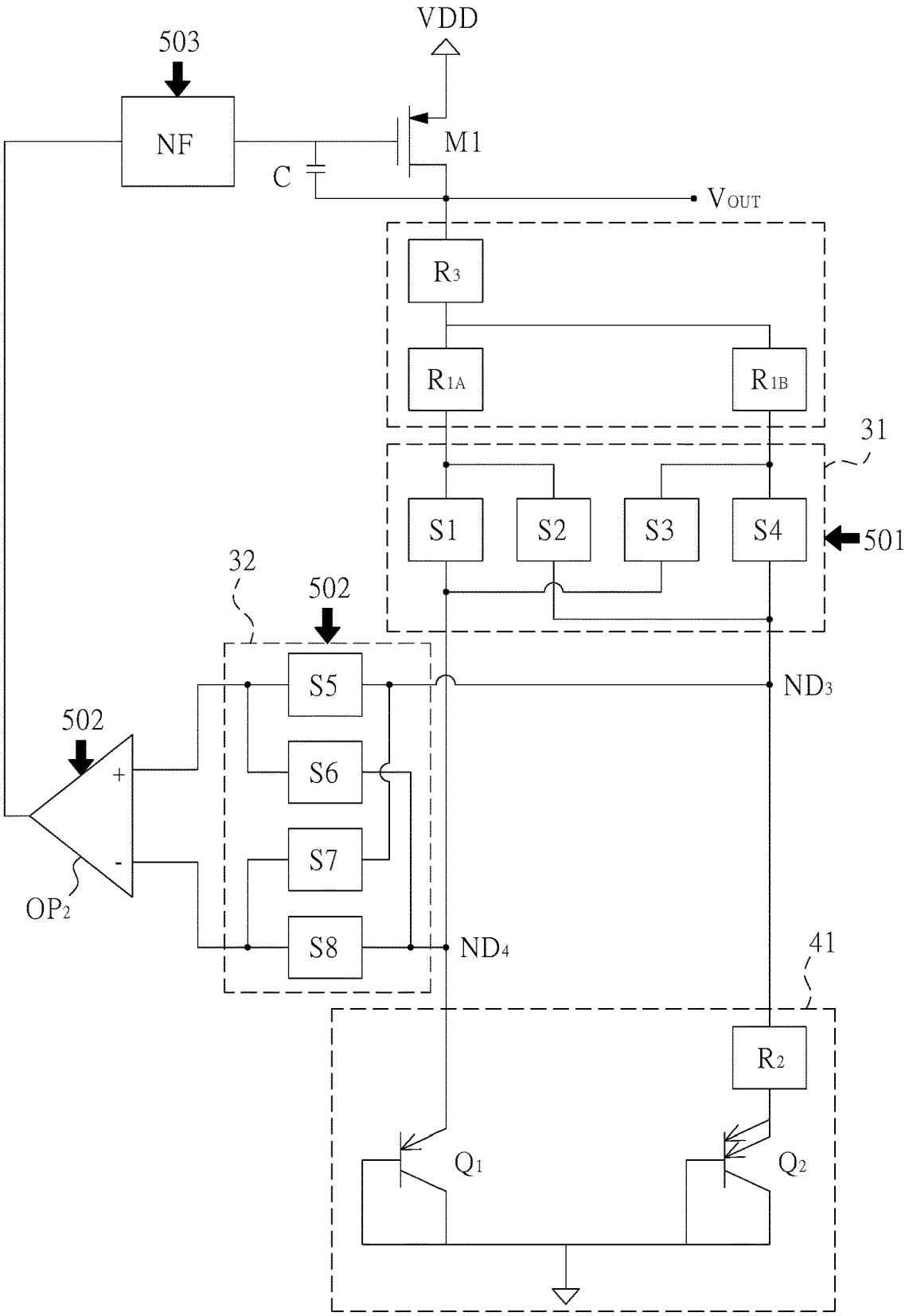
FIG. 5 is a schematic circuit diagram of a second embodiment of a band gap reference voltage generating circuit of the present invention.

Please refer to FIG. 3 and FIGS. 4A and 4B, are a schematic circuit diagram of a first embodiment of a band gap reference voltage generating circuit of the present invention, and schematic circuit diagrams of different operational states of the first embodiment of a band gap reference voltage generating circuit of the present invention, respectively.

As shown in FIG. 3, the first embodiment of the band gap reference voltage generating circuit comprises a reference voltage generating circuit 41 and a current generating circuit, and a current divider circuit 21, and a first connection path switching circuit 31. The reference voltage generating circuit 41 comprises a first bipolar junction transistor $Q_1$, the second bipolar junction transistor Q2, and a resistor $R_2$. The emitter of the first bipolar junction transistor Q1 is electrically connected to the current generating circuit and configured to receive current generated by the current generating circuit. The base and collector of the first bipolar junction transistor Q1 are electrically connected to each other and grounded. The emitter of the second bipolar junction transistor Q2 is electrically connected to a terminal of the resistor $R_2$, the base and collector of the second bipolar junction transistor Q2 are electrically connected to the base of the first bipolar junction transistor $Q_1$. The other terminal of the resistor R2 is electrically connected to the first connection path switching circuit 31. The emitter area of the second bipolar junction transistor Q2 is multiple times of the emitter area of the first bipolar junction transistor $Q_1$.

The current generating circuit comprise an operational amplifier $OP_1$, a signal filter, a PMOS transistor $M_1$, and a capacitor C. In this embodiment, the signal filter can be implemented by a notch filter NF; however, the present invention is not limit thereto. The capacitor C is electrically connected to the PMOS transistor M1. The operational amplifier $OP_1$ has a positive input terminal electrically connected to the terminal of the resistor R2, such as a node $ND_2$, and a negative input terminal electrically connected to the emitter of the first bipolar junction transistor $Q_1$, such as node $ND_1$, and an output terminal electrically connected to an input terminal of the notch filter NF. The output terminal of the notch filter NF is electrically connected to a gate of the PMOS transistor M1. The capacitor C is electrically connected to a source and the gate of the PMOS transistor M1. The source of the PMOS transistor M1 receives a supply voltage VDD, and a drain of the PMOS transistor M1 outputs the first current IB1.

The notch filter NF can filter an output signal of the operational amplifier $OP_1$ according to a third control signal 503. The frequency of the first control signal 501 is even times of the frequency of the third control signal 503; in a preferred embodiment, a ratio of the frequencies of the first control signal 501 to the third control signal 503 is 2:1.

The current divider circuit 21 comprise resistors $R_3$, $R_{1A}$, and $R_{1B}$, the resistors $R_3$ has a terminal electrically connected to the drain of the PMOS transistor M1, and other terminal electrically connected to terminals of the resistors $R_{1A}$ and $R_{1B}$.

The first connection path switching circuit 31 comprises a switch S1, a switch S2, a switch S3, and a switch S4. The terminals of the switches S1 and S2 are electrically connected to other terminal of the resistor $R_{1A}$ of the current divider circuit 21, and the other terminals of the switches S1 and S2 are electrically connected to the nodes $ND_2$ and $ND_1$, respectively; the terminals of the switches S3 and S4 are electrically connected to the other terminal of the resistor $R_{1B}$ of the current divider circuit 21, and other terminals of the switch S3 and S4 are electrically connected to the nodes ND2 and ND1, respectively.

The switches S1 and S4 are operated synchronously, and the switches S2 and S3 are operated synchronously. The switches S1 and S4, and the switches S2 and S3 are operated reversely; in other words, when the switches S1 and S4 are turned on, the switches S2 and S3 are turned off, as shown in FIG. 4A; when the switches S1 and S4 are turned off, the switches S2 and S3 are turned on, as shown in FIG. 4B.

The first connection path switching circuit 31 receives the first control signal 501, and the switches S1, S2, S3 and S4 are operated according to the first control signal 501. In an actual application, the first connection path switching circuit 31 can use an inverter to generate an inverting signal 501*a* of the first control signal 501, so that the first control signal 501 can be used to control the switches S1 and S4, and the inverting signal 501*a* can be used to control the switches S2 and S3. In an embodiment, the first control signal 501 can be a signal group including two control signals inverting to each other.

According to above-mentioned content, when the first connection path switching circuit 31 periodically switches the connection path, the positive input terminal of the operational amplifier $OP_1$ is periodically electrically connected to the resistors $R_{1A}$ and $R_{1B}$ in a sequential order; similarly, the negative input terminal of the operational amplifier OP1 is periodically electrically connected to the resistors $R_{1B}$ and $R_{1A}$, in a sequential order, so as to effectively decrease the effect of the resistance difference between the resistors $R_{1A}$ and $R_{1B}$ of the current divider circuit 20 applied the correlation between the output voltage VOUT of the band gap reference voltage generating circuit and temperature.

Please refer to FIG. 5, FIGS. 6A to 6D, and FIG. 7, which are a schematic circuit diagram of a second embodiment of a band gap reference voltage generating circuit of the present invention, schematic circuit diagrams of different operational states of the second embodiment of the present invention, and a control signal timing diagram of the second embodiment of the present invention, respectively, respectively.

In an ideal case, the voltage difference between the two input terminals of the operational amplifier should be 0V; however, in an actual case, the voltage difference being not 0V exist between the two input terminals of the operational amplifier. In order to eliminate the voltage difference between the two input terminals of the operational amplifier, the operational amplifier can periodically switch polarities of the two input terminals, and the second embodiment of the band gap reference voltage generating circuit uses this kind of operational amplifier.

The difference between the second embodiment and the first embodiment is that the second embodiment comprises a second connection path switching circuit 32, and the polarities of the two input terminals of the operational amplifier $OP_2$ of the current generating circuit are exchanged periodically.

The second connection path switching circuit 32 is electrically connected between the current generating circuit 10 and the first connection path switching circuit 31, and configured to switch the connection paths between the two input terminals of the operational amplifier OP2 of the current generating circuit 10, and the two output terminals, which are node $ND_3$ and $ND_4$, of the first connection path switching circuit 31.

The second connection path switching circuit 32 comprises switches S5, S6, S7 and S8, the terminals of the switches S5 and S6 are electrically connected to a first input terminal of the operational amplifier $OP_2$, and the other terminals of the switches S5 and S6 are electrically connected to the two output terminals, which are nodes ND3 and ND4, of the first connection path switching circuit 31, respectively. The terminals of the switches S7 and S8 are electrically connected to the second input terminal of the operational amplifier OP2, and the other terminals of the switches S7 and S8 are electrically connected to the two output terminals, which are nodes ND3 and ND4, of the first connection path switching circuit 31, respectively.

Figure 6A:
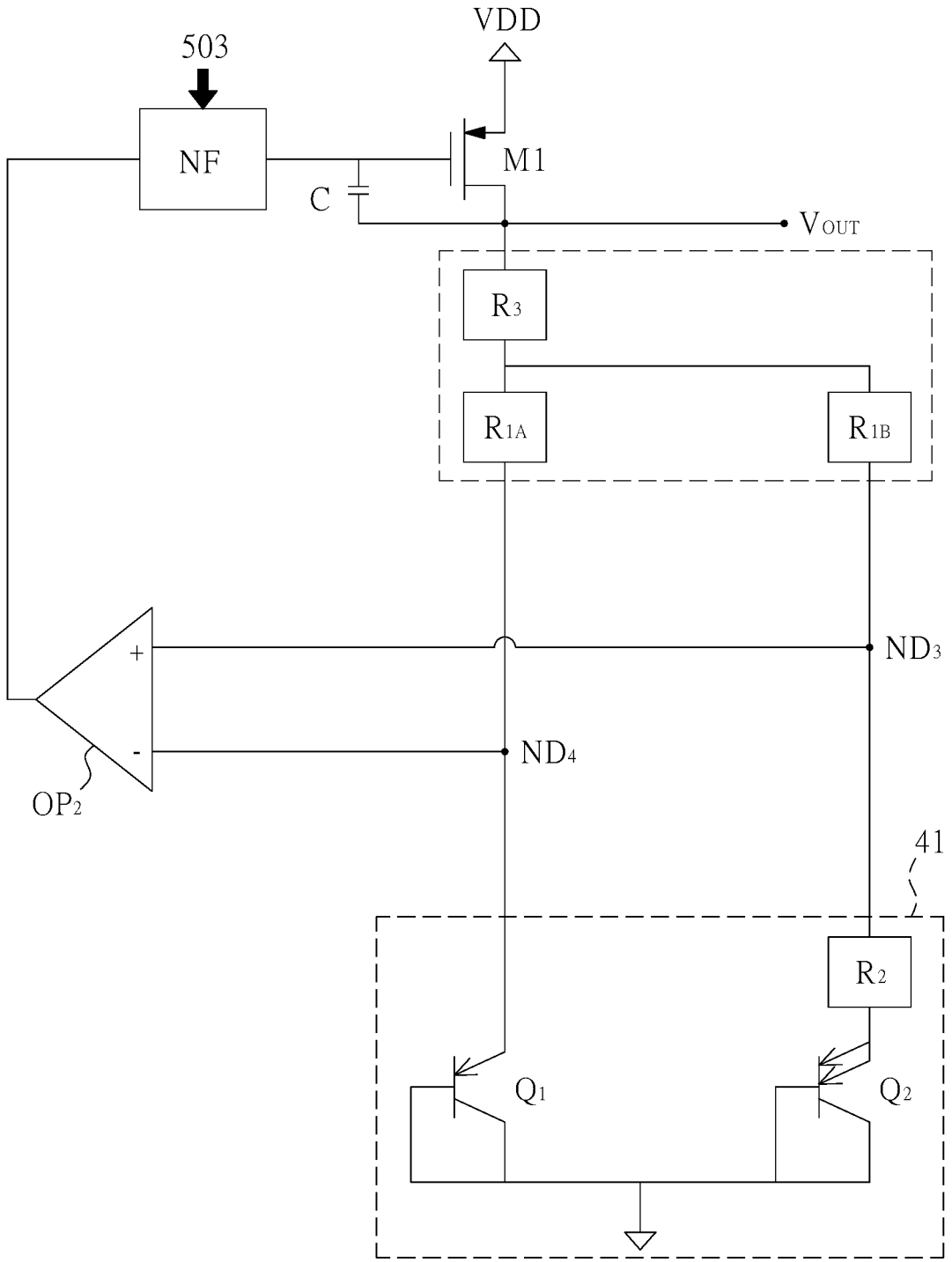
FIGS. 6A to 6D are schematic circuit diagrams showing different operational states of a second embodiment of a band gap reference voltage generating circuit of the present invention.
Figure 6B:
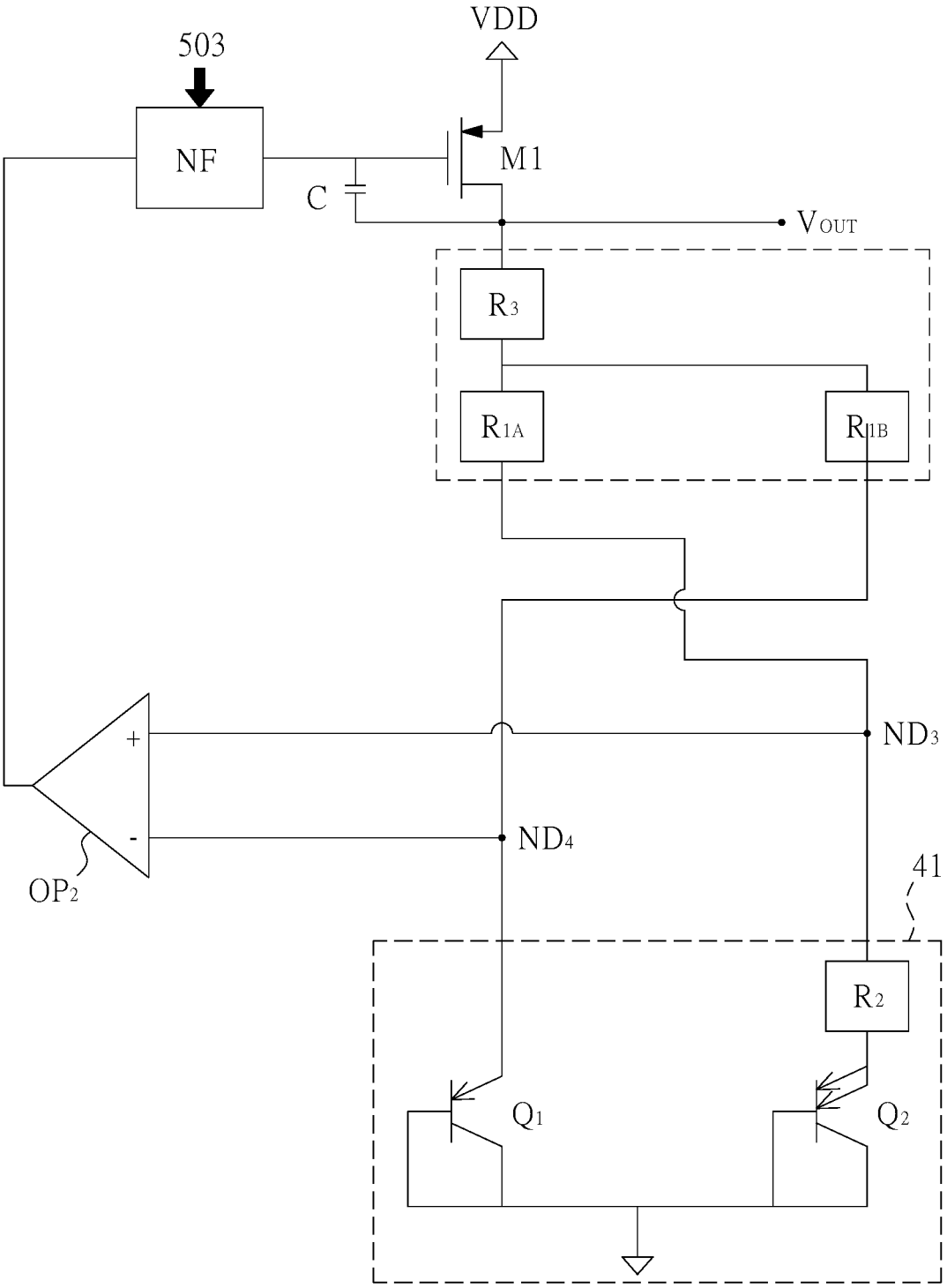
Figure 6C:
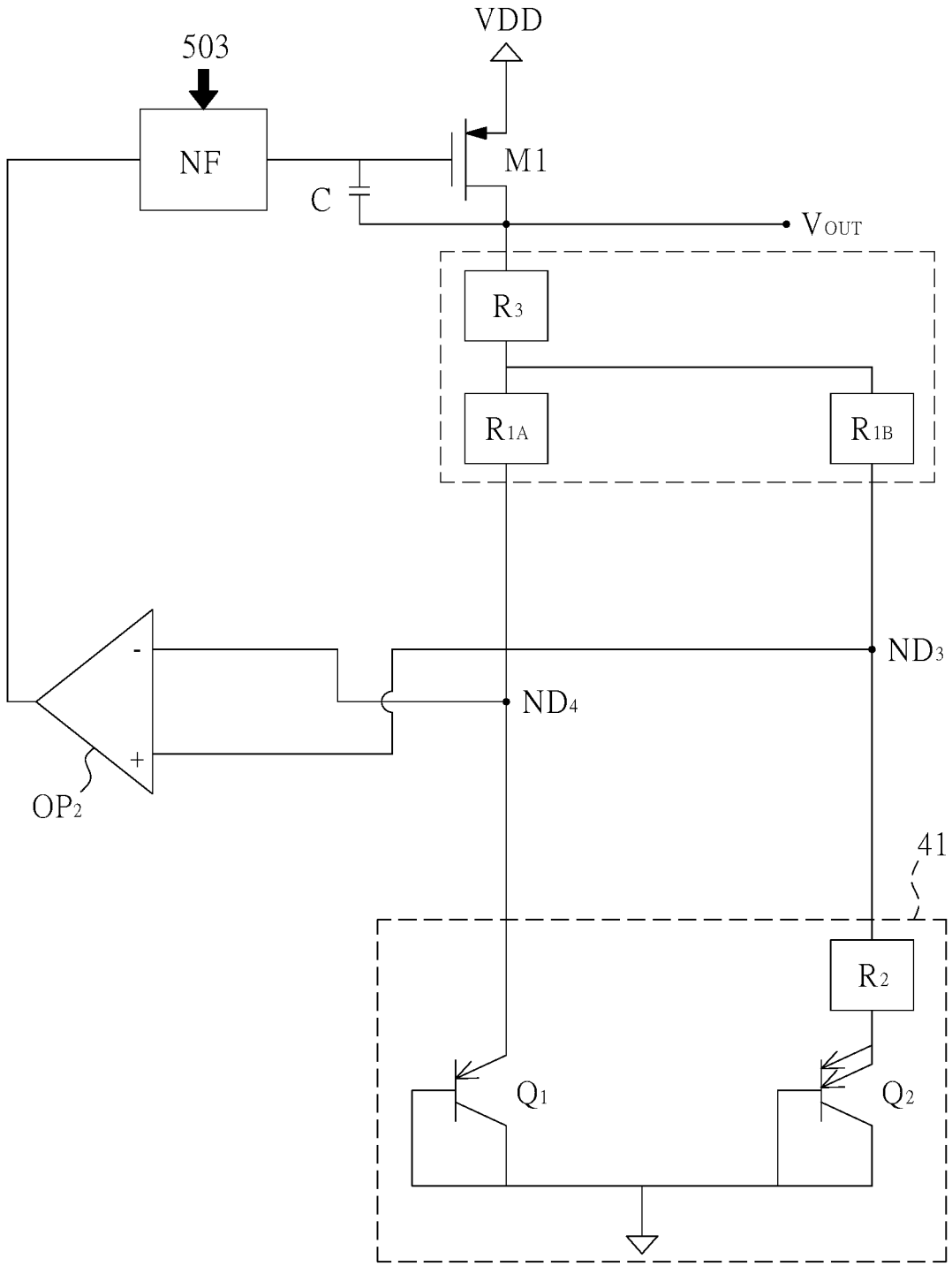
Figure 6D:
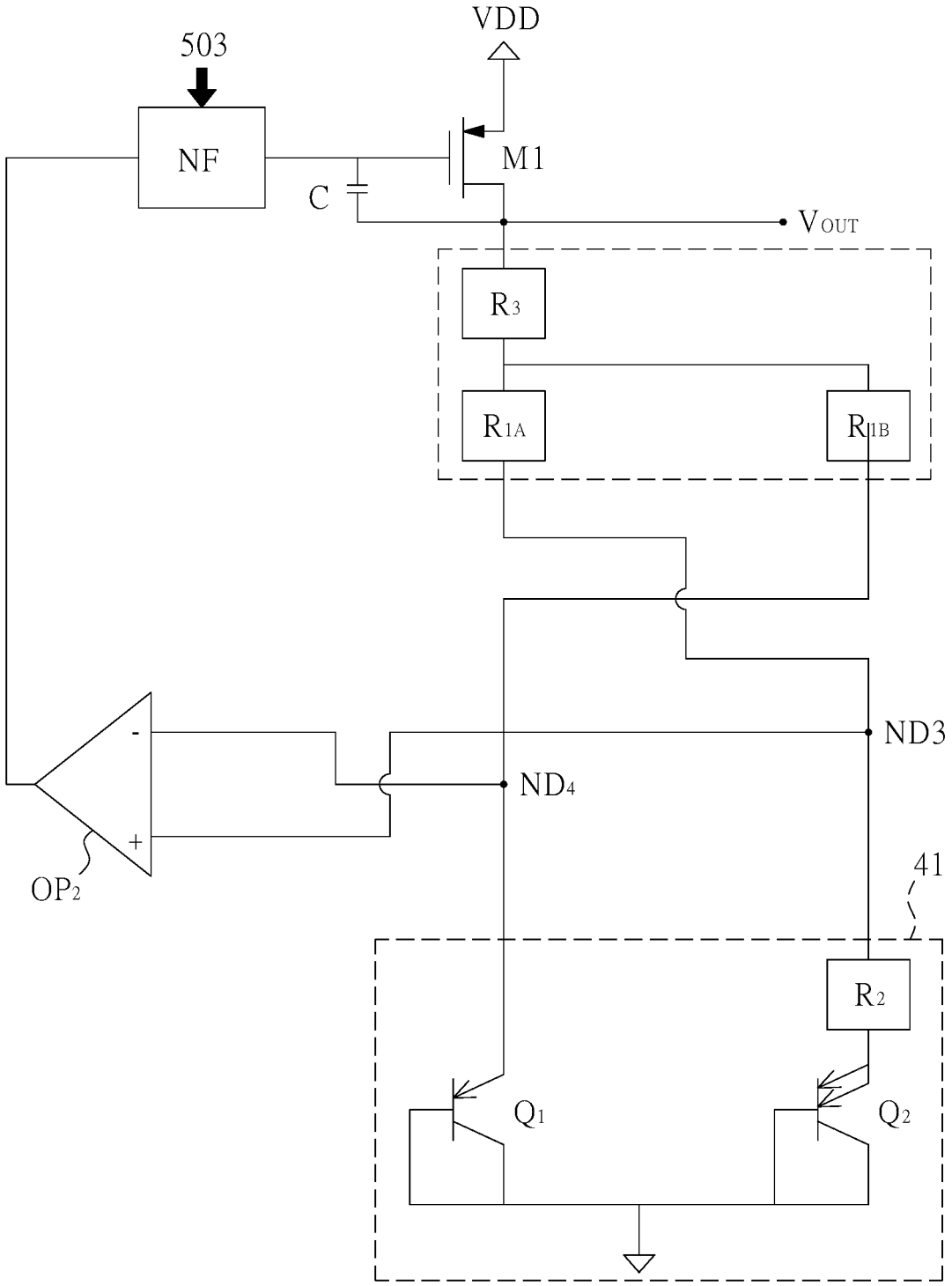

The switches S5 and S8 are operated synchronously, and the switches S6 and S7 are operated synchronously. The switches S5 and S8, and the switches S6 and S7 are operated reversely; in other words, when the switches S5 and S8 are turned on, the switches S6 and S7 are turned off, as shown in FIGS. 6A and 6B; when the switches S5 and S8 are turned off, the switches S6 and S7 are turned on, as shown in FIGS. 6C and 6D.

Figure 7:
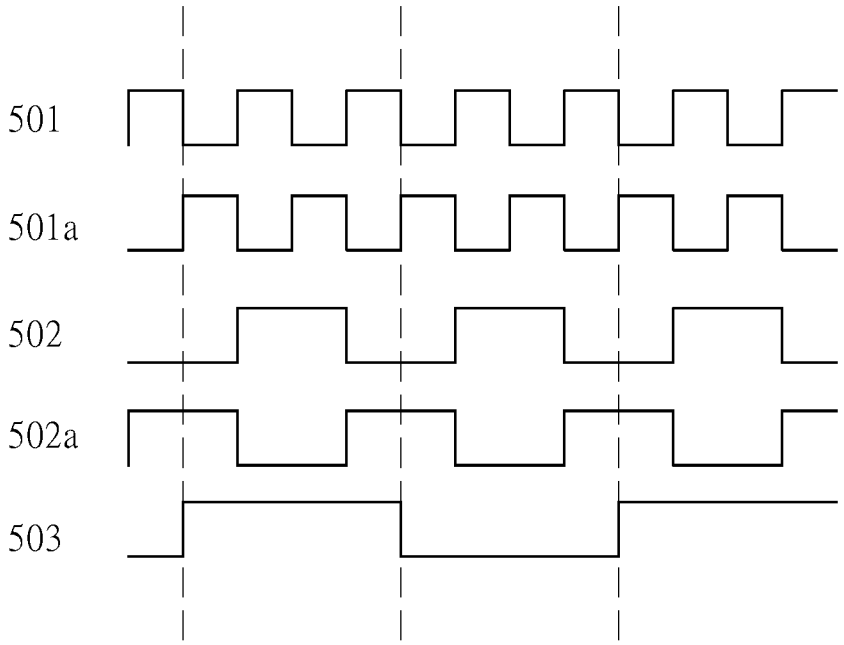
FIG. 7 is a control signal timing diagram of a second embodiment of a band gap reference voltage generating circuit of the present invention.

The second connection path switching circuit 32 receives the second control signal 502, and the switches S5, S6, S7 and S8 are operated according to the second control signal 502. The second control signal 502 can comprise two signals for controlling the switches S5 and S8, and the switches S6 and S7, respectively; in an embodiment, the second connection path switching circuit 32 can comprise an inverter configured to generate an inverting signal 502*a* of the second control signal 502, so that the second control signal 502 can be used to control the switches S5 and S8, and the inverting signal 502*a* of the second control signal 502 can be used to control the switches S6 and S7; the same mechanism can also be applied to first control signal 501, for example, the first control signal 501 can be used to control the switches S1 and S4, and the inverting signal 501*a* of the first control signal 501 can be used to control the switches S2 and S3, as shown in FIG. 7.

Furthermore, the polarities of the two input terminals of the operational amplifier $OP_2$ can be exchanged according to the second control signal 502. For example, in FIGS. 6A and 6B, the first input terminal of the operational amplifier $OP_2$ is a positive input terminal, and the second input terminal is a negative input terminal; in FIGS. 6C and 6D, the first input terminal of the operational amplifier $OP_2$ is a negative input terminal, and the second input terminal is a positive input terminal. The frequencies of the first control signal 501, the second control signal 502 and the third control signal 503 are in an even ratio, for example, a ratio of frequencies of the first control signal 501 to the second control signal 502 is 1:2 or 2:1. In a preferred embodiment, a ratio of the frequency of the first control signal 501 to the frequency of the second control signal 502 to the frequency of the third control signal 503 can be 4:2:1, as shown in FIG. 7. In other words, every time the polarities of the two input terminals of the operational amplifier $OP_2$ are exchanged, each of the input terminals of the operational amplifier $OP_2$ is electrically connected to the resistors $R_{1A}$ and $R_{1B}$ of the current divider circuit 21 in a sequential order. The above-mentioned operation can be performed periodically to effectively decrease the effect of the resistance difference between the resistor $R_{1A}$ and $R_{1B}$ of the current divider circuit 20 applied on the correlation between the reference voltage $V_{OUT}$ and the temperature.

Figure 8:
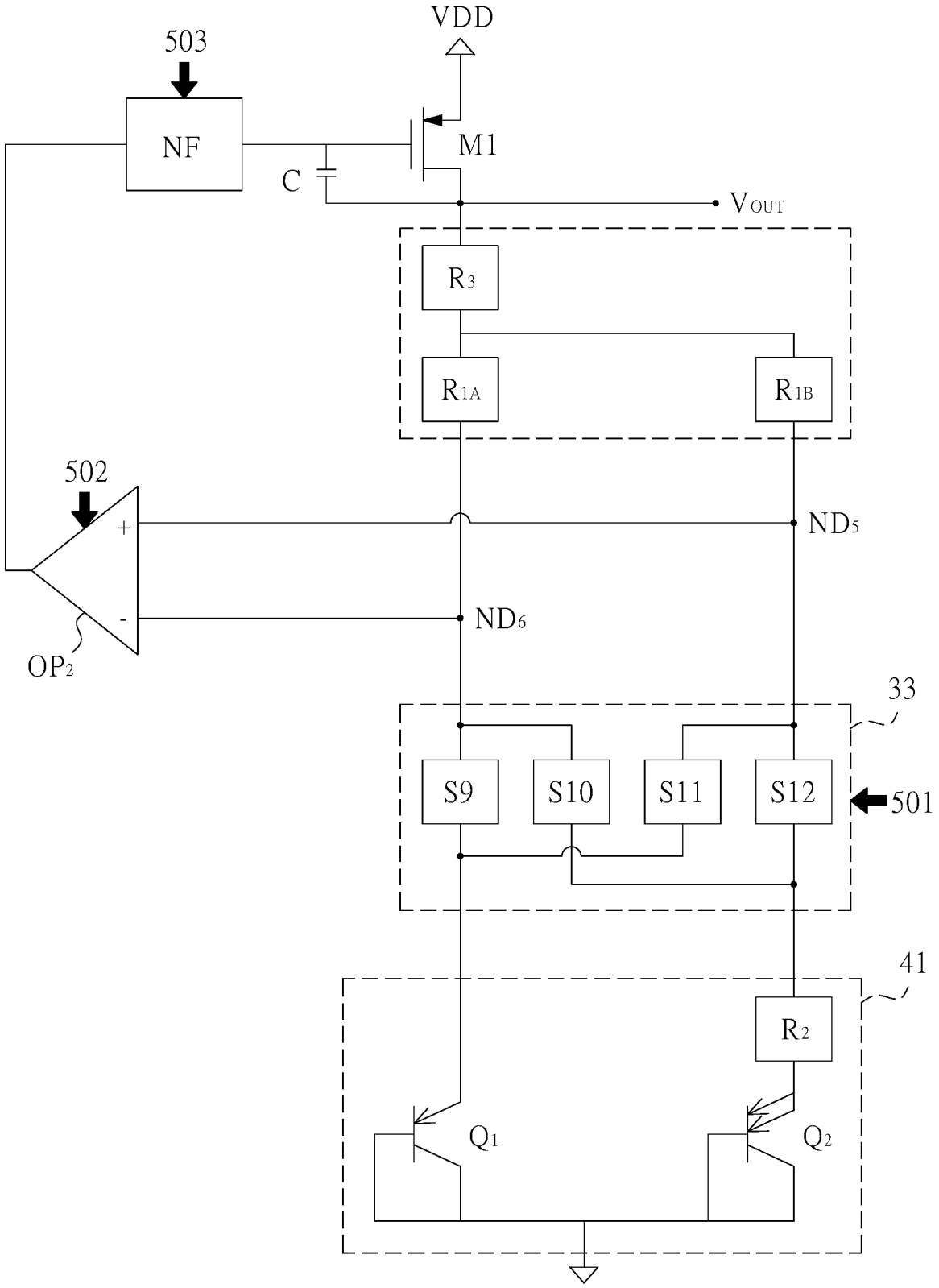
FIG. 8 is a schematic circuit diagram of a third embodiment of a band gap reference voltage generating circuit of the present invention.
Figure 9A:
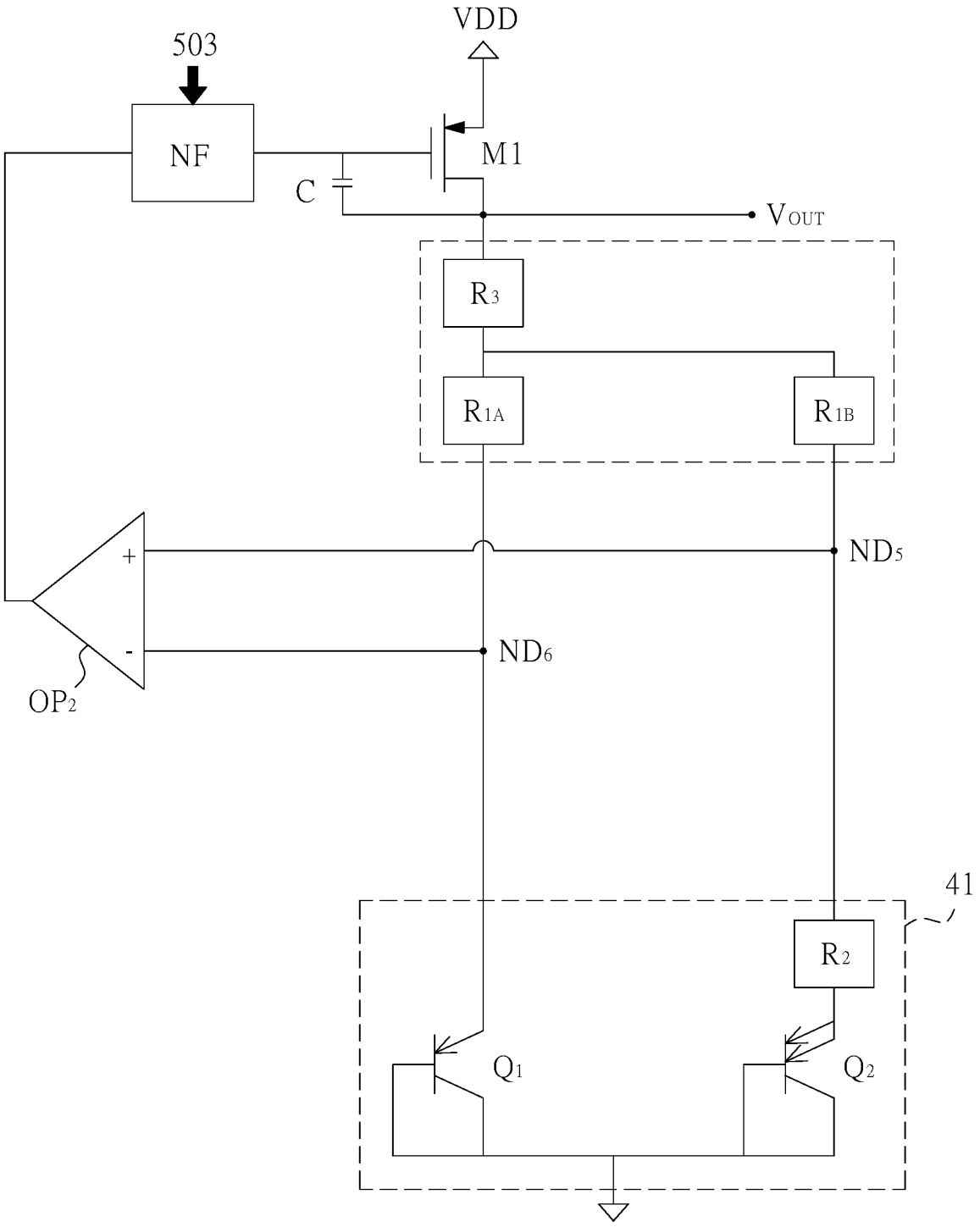
FIGS. 9A and 9D are schematic circuit diagrams showing different operational states of a third embodiment of a band gap reference voltage generating circuit of the present invention.
Figure 9B:
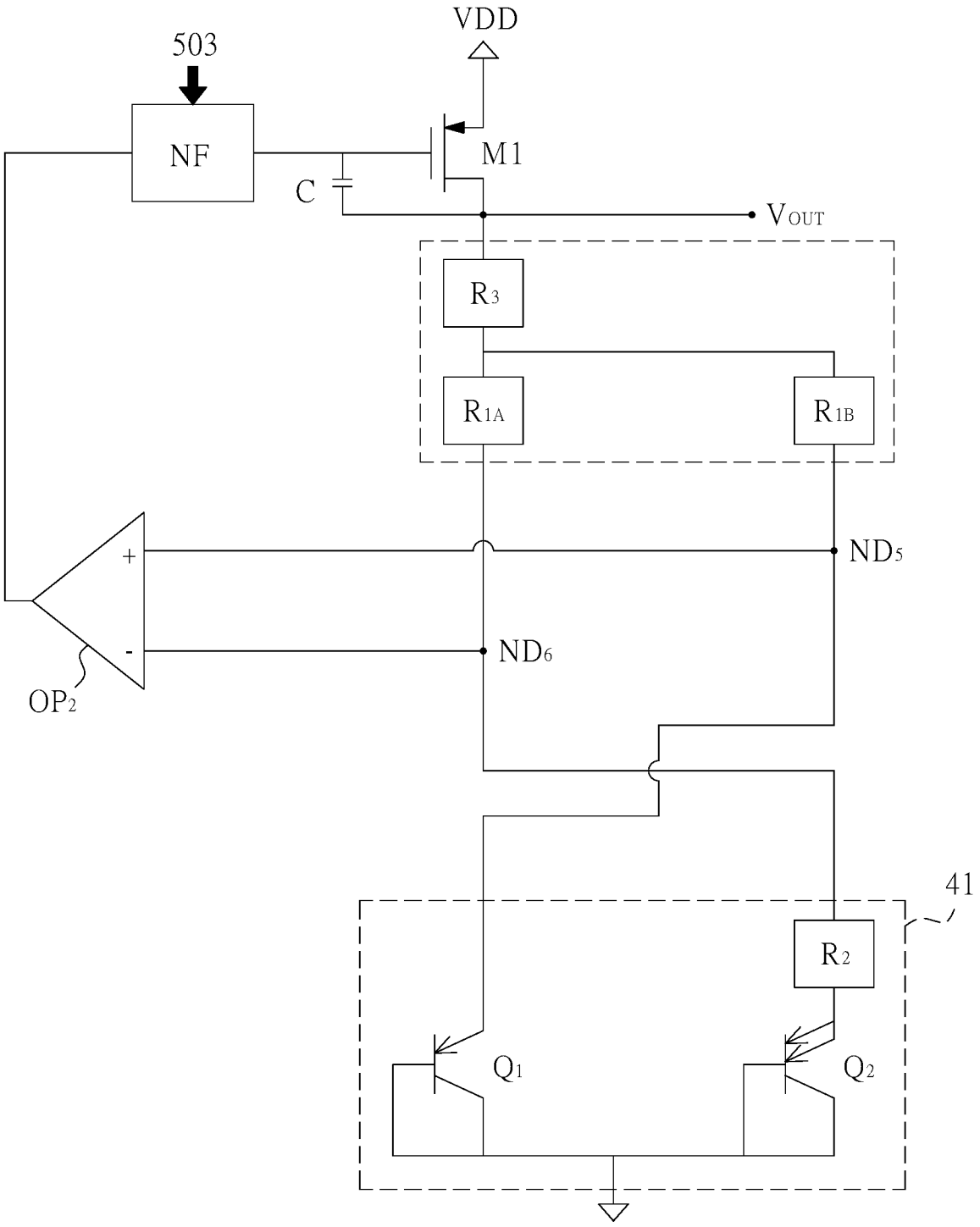

Please refer to FIGS. 8, 9A and 9B, which are a schematic circuit diagram of a third embodiment of a band gap reference voltage generating circuit of the present invention, and schematic circuit diagrams showing different operational states of the third embodiment of the present invention, respectively, respectively.

The difference between the third embodiment and aforementioned embodiments is that the connection path switching circuit 33 of the third embodiment is electrically connected between the current generating circuit and the reference voltage generating circuit 41, and the polarities of the two input terminals of the operational amplifier $OP_2$ of the current generating circuit are exchangeable.

The connection path switching circuit 33 can switch the connection paths between the two input terminals of the current generating circuit and the two current input terminals of the reference voltage generating circuit 41 according to the first control signal 501. The operational amplifier $OP_2$ can exchange the polarities of the two input terminals thereof according to the second control signal 502, a ratio of the frequency of the second control signal 502 to the frequency and the first control signal 501 is an even number; in a preferred embodiment, the ratio of the frequencies of the first control signal 501 to second control signal 502 to third control signal 503 is 4:2:1.

The connection path switching circuit 33 can include switches S9, S10, S11 and S12. The terminals of the switches S9 and S10 are electrically connected to the first input terminal, which is a node $ND_6$, of the operational amplifier $OP_2$, and the other terminals of the switches S9 and S10 are electrically connected to the emitter of the bipolar junction transistor $Q_1$ and the resistor $R_2$, respectively. The terminals of the switches S11 and S12 are electrically connected to the second input terminal, which is the node $ND_5$, of the operational amplifier $OP_2$, the other terminals of the switches S11 and S12 are electrically connected to the emitter of the bipolar junction transistor $Q_1$ and the resistor $R_2$, respectively.

Figure 9C:
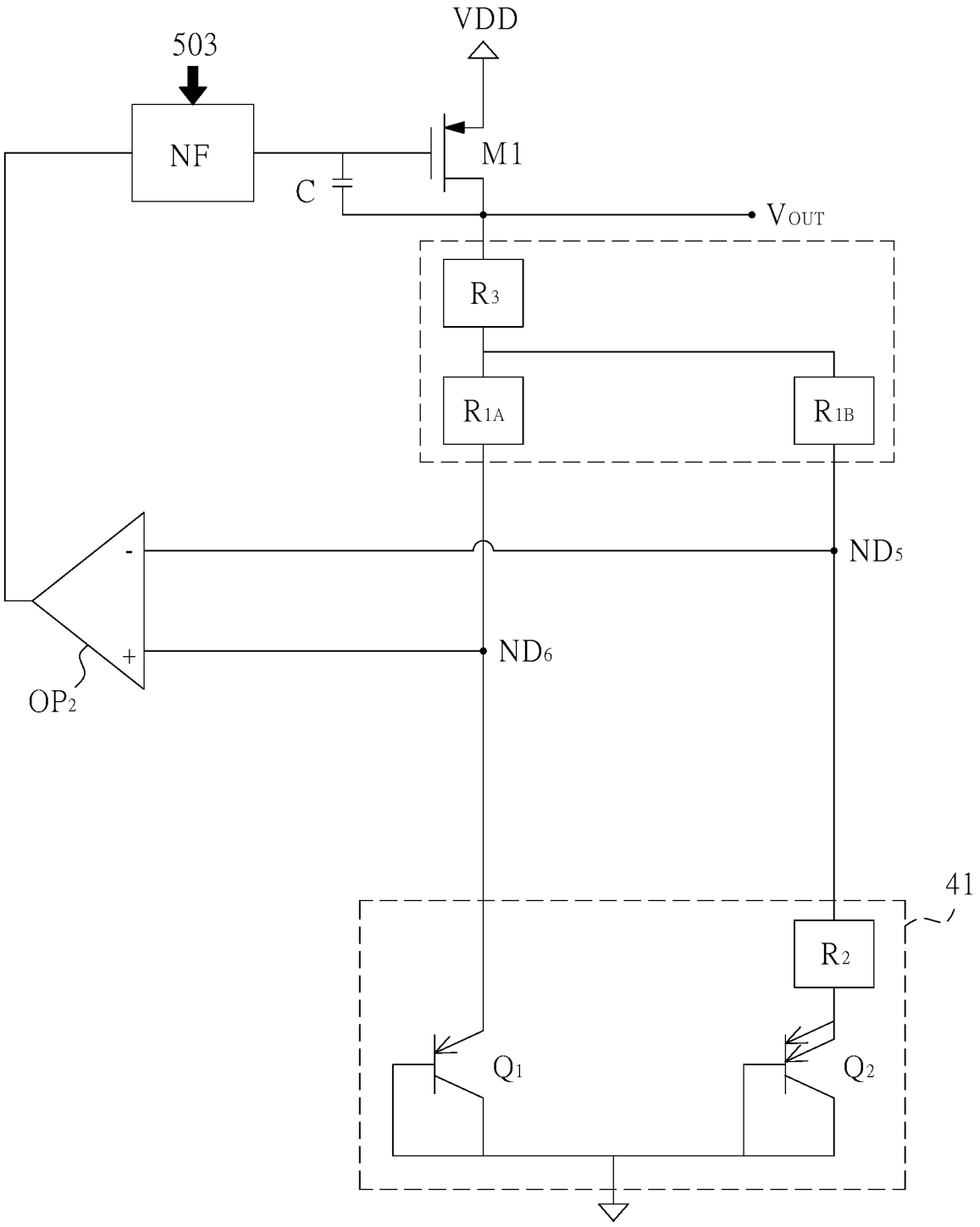
Figure 9D:
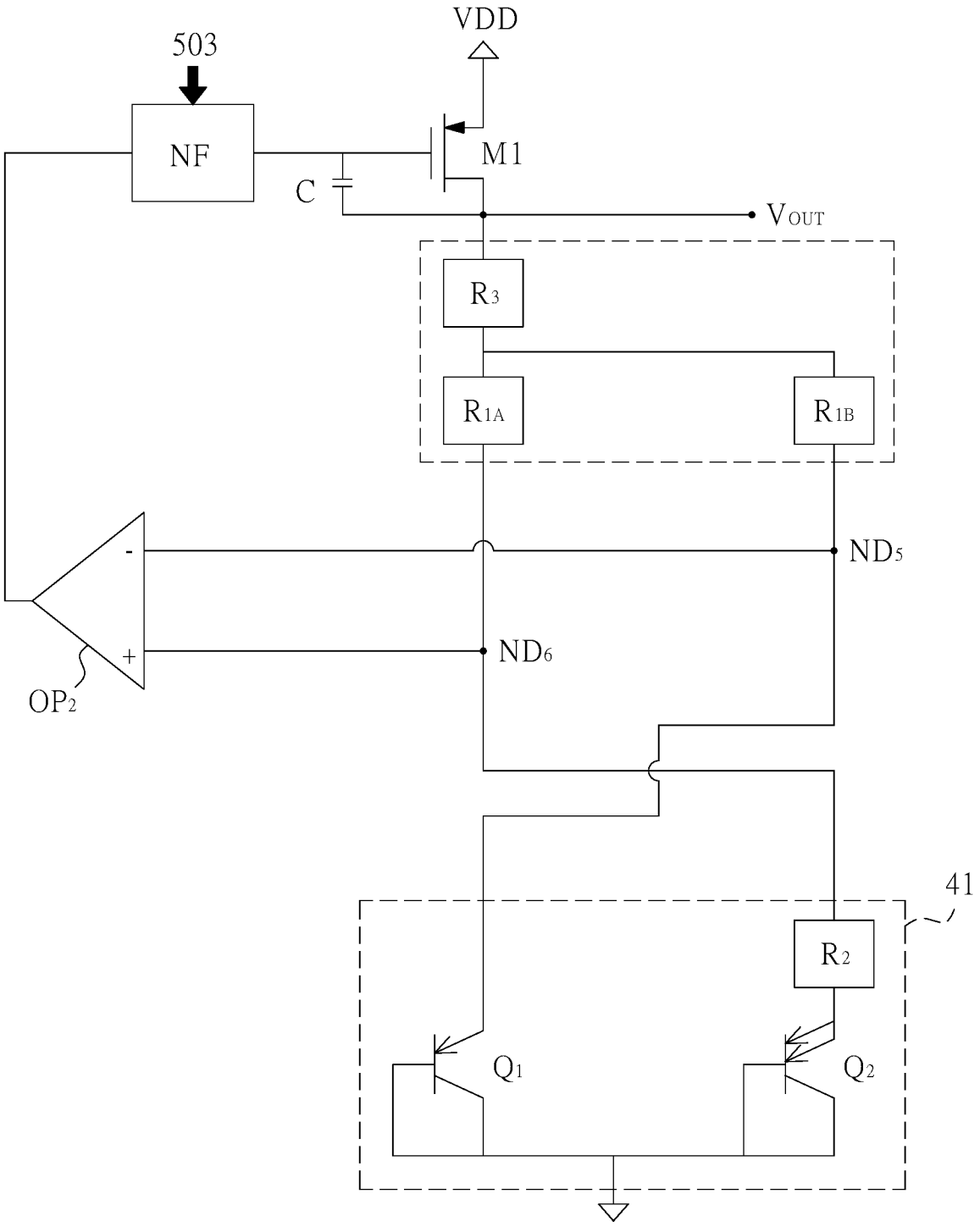

The switches S9 and S12 are operated synchronously, and the switches S10 and S11 are operated synchronously. The switches S9 and S12, and the switch S10 and S11 are operated reversely. In other words, when the switches S9 and S12 are turned on, the switches S10 and S11 are turned off, as shown in FIGS. 9A and 9B; when the switches S9 and S12 are turned off, the switches S10 and S11 are turned on, as shown in FIGS. 9C and 9D. In an actual application, the connection path switching circuit 33 can use an inverter to generate an inverting signal of the second control signal 502, so that the second control signal 502 can be used to control the switches S9 and S12, and the inverting signal of the second control signal 502 can be used to control the switches S10 and S11.

In a preferred embodiment, a ratio of the frequencies of the first control signal 501 to the second control signal 502 can be 2:1, In other words, every time the polarities of the two input terminals of the operational amplifier $OP_2$ are exchanged, each of the input terminals of the operational amplifier $OP_2$ is electrically connected to the emitter of the bipolar junction transistor Q1 and the resistor R2 in a sequential order, so that the effect of the resistance difference between the resistor $R_{1A}$ and $R_{1B}$ can be applied to two input terminals of the operational amplifier $OP_2$ periodically, so as to effectively decrease the effect of the resistance difference between the resistors $R_{1A}$ and $R_{1B}$ of the current divider circuit 21 applied on the correlation between the reference voltage $V_{OUT}$ and temperature.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A band gap reference voltage generating circuit, comprising:

a reference voltage generating circuit comprising a first current input terminal and a second current input terminal, and configured to form a reference voltage on the first current input terminal and the second current input terminal;

a current generating circuit comprising a first input terminal and a second input terminal electrically connected to the first current input terminal and the second current input terminal, respectively, wherein the current generating circuit is configured to generate a first current to bias the reference voltage generating circuit;

a current divider circuit comprising a current input terminal, a first current output terminal and a second current output terminal, wherein the current input terminal receives the first current, and a voltage on the current input terminal of the current divider circuit serves as an output voltage of the band gap reference voltage generating circuit;

a first connection path switching circuit electrically connected between the current generating circuit and the current divider circuit, and configured to switch connection paths between the first input terminal and the second input terminal of the current generating circuit and the first current output terminal and the second current output terminal of the current divider circuit; and a control circuit configured to generate a first control signal to periodically control a switching operation of the first connection path switching circuit;

wherein the current generating circuit comprises a first operational amplifier, a signal filter, and a MOS transistor, a first input terminal of the first operational amplifier serves as the first input terminal of the current generating circuit, a second input terminal of the first operational amplifier serves as the second input terminal of the current generating circuit, an output terminal of the first operational amplifier is electrically connected to an input terminal of the signal filter, an output terminal of the signal filter is electrically connected to a gate of the MOS transistor, a source of the MOS transistor receives a supply voltage, and a drain of the MOS transistor outputs the first current.

2. The band gap reference voltage generating circuit according to claim 1, wherein the current divider circuit comprises a first resistor, a second resistor, and a third resistor, the first resistor has a terminal electrically connected to the current generating circuit, and an other terminal electrically connected to terminals of the second resistor and the third resistor, and other terminals of the second resistor and the third resistor are electrically connected to the first connection path switching circuit.

3. The band gap reference voltage generating circuit according to claim 1, wherein the reference voltage generating circuit comprises a first bipolar junction transistor, a second bipolar junction transistor, and a fourth resistor, an emitter of the first bipolar junction transistor is electrically connected to the first connection path switching circuit, and base and collector of the first bipolar junction transistor are electrically connected to each other, an emitter of the second bipolar junction transistor is electrically connected to a terminal of the fourth resistor, base and collector of the second bipolar junction transistor are electrically connected to the base of the first bipolar junction transistor, an other terminal of the fourth resistor is electrically connected to the first connection path switching circuit, and an emitter area of the second bipolar junction transistor is multiple times of an emitter area of the first bipolar junction transistor.

4. The band gap reference voltage generating circuit according to claim 1, wherein the first connection path switching circuit comprises a first switch, a second switch, a third switch, and a fourth switch, terminals of the first switch and the second switch are electrically connected to the first current output terminal of the current divider circuit, and other terminals of the first switch and the second switch are electrically connected to the first current input terminal and the second current input terminal of the reference voltage generating circuit, respectively, and terminals of the third switch and the fourth switch are electrically connected to the second current output terminal of the current divider circuit, and other terminals of the third switch and the fourth switch are electrically connected to the first current input terminal and the second current input terminal of the reference voltage generating circuit, respectively.

5. The band gap reference voltage generating circuit according to claim 1, wherein the band gap reference voltage generating circuit further comprises a second connection path switching circuit electrically connected between the current generating circuit and the first connection path switching circuit, and is configured to switch the connection paths between the two input terminals of the first operational amplifier of the current generating circuit, and the two output terminals of the first connection path switching circuit;

wherein polarities of the two input terminals of the first operational amplifier are exchangeable.

6. The band gap reference voltage generating circuit according to claim 5, wherein the control circuit generates a second control signal to periodically control a switching operation of the second connection path switching circuit to exchange the polarities of the input terminals of the first operational amplifier.

7. A band gap reference voltage generating circuit, comprising:

a reference voltage generating circuit comprising a first current input terminal and a second current input terminal, and configured to form a reference voltage on the first current input terminal and the second current input terminal;

a current generating circuit comprising a first input terminal and a second input terminal electrically connected to the first current input terminal and the second current input terminal, respectively, wherein the current generating circuit is configured to generate a first current to bias the reference voltage generating circuit, wherein the current generating circuit comprises an operational amplifier, a signal filter, and a MOS transistor, a first input terminal of the operational amplifier serves as the first input terminal of the current generating circuit, a second input terminal of the operational amplifier serves as the second input terminal of the current generating circuit, an output terminal of the operational amplifier is electrically connected to an input terminal of the signal filter, and polarities of the two input terminals of the operational amplifier are exchangeable, an output terminal of the signal filter is electrically connected to a gate of the MOS transistor, a source of the MOS transistor receives a supply voltage, and a drain of the MOS transistor outputs the first current;

a current divider circuit comprising a current input terminal, a first current output terminal, and a second current output terminal, wherein the current input terminal receives the first current, and a voltage on the current input terminal of the current divider circuit serves as the output voltage of the band gap reference voltage generating circuit;

a connection path switching circuit electrically connected between the current generating circuit and the reference voltage generating circuit, and configured to switch connection paths between the first input terminal and the second input terminal of the current generating circuit, and the first current input terminal and the second current input terminal of the reference voltage generating circuit; and a control circuit configured to generate a first control signal to periodically control a switching operation of the connection path switching circuit, and generate a second control signal to periodically exchange the polarities of the two input terminals of the operational amplifier.

8. The band gap reference voltage generating circuit according to claim 7, wherein the current divider circuit comprises a first resistor, a second resistor, and a third resistor, a terminal of the first resistor is electrically connected to the current generating circuit, and other terminal of the first resistor is electrically connected to terminals of the second resistor and the third resistor, and other terminals of the second resistor and the third resistor are electrically connected to the connection path switching circuit.

9. The band gap reference voltage generating circuit according to claim 7, wherein the connection path switching circuit comprises a first switch, a second switch, a third switch, and a fourth switch, terminals of the first switch and the second switch are electrically connected to the first input terminal of the current generating circuit, and other terminals of the first switch and the second switch are electrically connected to the first current input terminal and the second current input terminal of the reference voltage generating circuit, respectively, wherein terminals of the third switch and the fourth switch are electrically connected to the second input terminal of the current generating circuit, and other terminals of the third switch and the fourth switch are electrically connected to the first current input terminal and the second current input terminal of the reference voltage generating circuit, respectively.

* * * * *